US006779685B2

(12) United States Patent
Nelson

(10) Patent No.: US 6,779,685 B2
(45) Date of Patent: Aug. 24, 2004

(54) PRESSURE CONTROLLED METHOD FOR DISPENSING A CARBONATED BEVERAGE

(75) Inventor: Patrick L. Nelson, Sun Prairie, WI (US)

(73) Assignee: Dispensing Systems International, LLC, Madison, WI (US)

( * ) Notice: Subject to any disclaimer, the term of this patent is extended or adjusted under 35 U.S.C. 154(b) by 0 days.

(21) Appl. No.: 10/317,258

(22) Filed: Dec. 11, 2002

(65) Prior Publication Data

US 2004/0112455 A1 Jun. 17, 2004

(51) Int. Cl.[7] ..... B65B 3/04

(52) U.S. Cl. ..... 222/1; 222/56; 222/61; 222/129.1; 222/396; 222/397; 222/399; 222/402.1; 141/356

(58) Field of Search ..... 222/1, 61, 56, 222/129.1, 129.2, 394, 396, 397, 399, 402.1, 402.11; 141/356

(56) References Cited

U.S. PATENT DOCUMENTS

| | | | |
|---|---|---|---|
| 3,876,107 A | 4/1975 | Meindl et al. | |
| 3,881,636 A | 5/1975 | D'Aubreby | |
| 3,978,900 A | 9/1976 | Mencacci et al. | |
| 4,560,089 A | 12/1985 | McMillin et al. | |
| 5,566,732 A | 10/1996 | Nelson | |
| 5,603,363 A | 2/1997 | Nelson | |
| 6,237,652 B1 | 5/2001 | Nelson | |
| 6,530,400 B2 * | 3/2003 | Nelson | 141/2 |

FOREIGN PATENT DOCUMENTS

| | | |
|---|---|---|
| DE | 3435725 A1 | 4/1985 |
| EP | 0 861 801 A1 | 2/1998 |

* cited by examiner

*Primary Examiner*—J. Casimer Jacyna
(74) *Attorney, Agent, or Firm*—George E. Haas; Quarles & Brady LLP

(57) ABSTRACT

A carbonated beverage is furnished from a source at a first pressure to a reservoir in which a quantity of the beverage is held a second pressure level that is less than the first pressure and greater than atmospheric pressure. When it is desired to dispense the carbonated beverage into a serving container, the reservoir is vented to the atmosphere so that the beverage is dispensed at substantially atmospheric pressure. The amount of carbonated beverage in the reservoir is sensed and when that amount drops below a first level, carbonated beverage is added from the source while the reservoir is vented to the atmosphere. The venting terminates when the amount of beverage in the reservoir reaches a second level. The beverage continues to flow into the reservoir thereafter for a predefined period of time causing the pressure to increase to the second pressure level.

17 Claims, 1 Drawing Sheet

PRESSURE CONTROLLED METHOD FOR DISPENSING A CARBONATED BEVERAGE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to equipment for dispensing a carbonated beverage into an open container from which the beverage will be consumed; and more particularly to such equipment in which the dispensing occurs in a manner that minimizes foaming of the beverage.

2. Description of the Related Art

It is common for carbonated beverages, such as soda and beer, to be supplied in a sealed canister or keg that then is connected to a tap at an establishment, at which the beverage is to be served. As used herein the term "establishment" includes businesses, residences and other facilities at which a carbonated beverage is served. Pressurized gas, such as carbon dioxide, is injected into the keg to force the liquid beverage through an outlet tube to the tap from which it is dispensed into serving containers of various sizes.

The carbonated beverage usually foams upon entering the serving container. As a consequence, personnel operating the tap typically fill the serving container until the level of foam reaches the brim and then wait for the foam to settle before adding additional beverage. In some instances several iterations of this process are required before the container is filled with liquid to the proper serving level. Such "topping off" necessitated by the foaming of the beverage prolongs the dispensing operation and impedes the ability to fully automate carbonated beverage dispensing.

Automated dispensing is particularly useful in establishments where large volumes of beverages are served, such as sports arenas and stadiums. It is desirable at such facilities to fill each container to the full serving level as fast as possible with minimal waste.

U.S. Pat. No. 5,603,363 describes a dispensing system which satisfies that desire. In that system, the carbonated beverage is fed into an elevated tank which is open to the atmosphere so that the beverage stored therein is at atmospheric pressure at all times. A spout is located beneath the tank and has a valve through which the beverage flows into a serving container. Selective operation of the valve and movement of the serving container enable rapid dispensing with minimal foaming. As a result of the tank being open to the atmosphere, the beverage tends to degas upon prolonged storage in the tank. In addition, there is a concern that bacteria and other substances may enter the open tank and contaminate the beverage therein, especially between hours of operation of the beverage establishment.

Alternative systems, such as described in U.S. Pat. No. 3,881,636, employ a closed tank with a vent tube at the top of the tank that provides a restricted passage to the atmosphere. The beverage is fed to the tank under the same pressure as in the keg and is maintained substantially at that elevated pressure until a spout is opened to fill a glass. At that time the tank pressure is reduced to the atmospheric level before the valve on the spout is opened. In a high volume dispensing establishment, this latter type of dispensing system has the disadvantage that time is lost while the reservoir is brought down to atmospheric pressure before the spout is opened. A further delay results from having to raise the tank to the keg pressure in order replenish the beverage in the tank. Thus it is desirable to increase the speed of dispensing further. In addition, this latter system has a small orifice through which the tank always is open to the atmosphere. Thus contaminants may enter this tank during prolonged periods of non-use.

SUMMARY OF THE INVENTION

To dispense a carbonated beverage into a serving container, a reservoir of a dispenser is connected to a source which supplies the carbonated beverage at a first pressure level that is greater than atmospheric pressure. A quantity of the carbonated beverage is held in the reservoir at a second pressure level that is less than the first pressure level and substantially greater than atmospheric pressure. This intermediate second pressure level inhibits gas from escaping from the beverage so that the carbonation is maintained.

When it is desired to dispense the carbonated beverage into the serving container, a vent passage between the reservoir and an ambient environment is opened to lower pressure in the reservoir to substantially atmospheric pressure. After the reservoir is at substantially atmospheric pressure, another passage in opened through which the beverage flows from the reservoir into the serving container. Foaming that often occurs as a carbonated beverage flows into a serving container is minimized by reducing the reservoir pressure to substantially atmospheric pressure.

In the preferred embodiment of the dispensing method, the amount of carbonated beverage contained in the reservoir is sensed. When less than a first amount of carbonated beverage is in the reservoir, carbonated beverage is transferred from the source into the reservoir. Thereafter, when carbonated beverage in the reservoir reaches a second amount, the vent passage is closed. The transfer of the carbonated beverage is terminated a predefined period of time after closing the vent passage, wherein the quantity of the beverage that enters the reservoir during that predefined period of time causes the pressure to increase to the second pressure level.

DETAILED DESCRIPTION OF THE INVENTION

Figure 1:
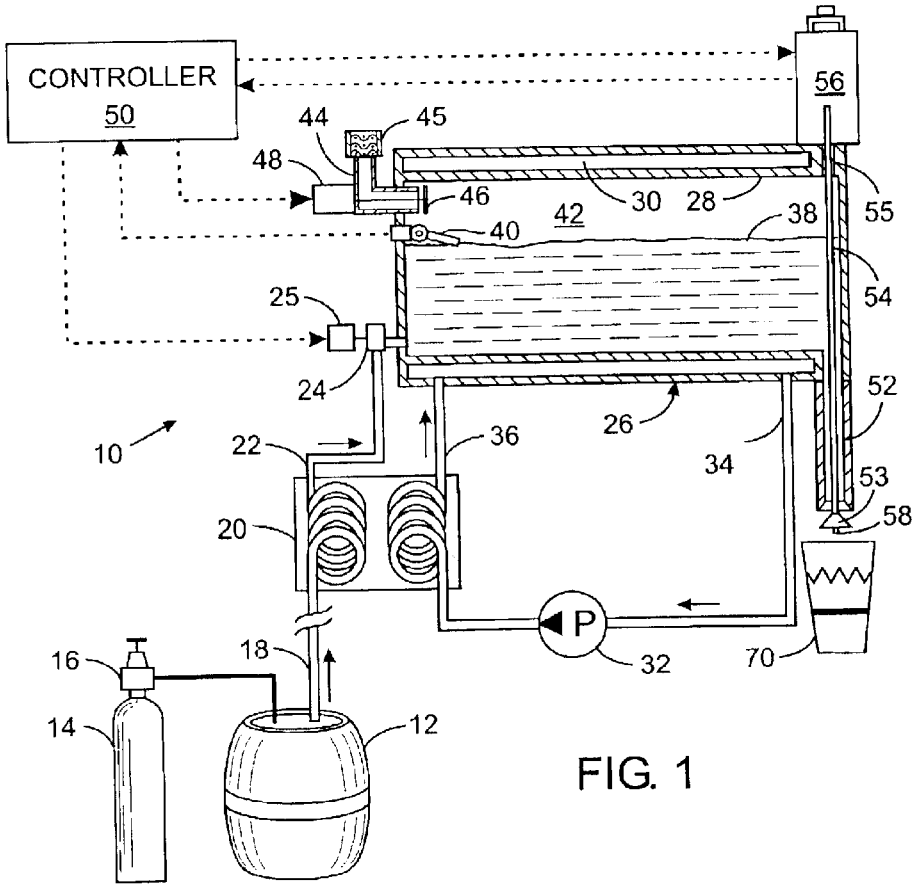
FIG. 1 is a schematic diagram of a beverage dispensing system according to the present invention.

With initial reference to FIG. 1, a beverage dispensing system 10 receives a fully mixed carbonated beverage, such as beer or soda from a keg 12. A source of pressurized gas, for example a cylinder 14 of carbon dioxide, is connected by a pressure regulator 16 to an inlet of the keg 12. The pressure regulator 16 maintains the internal pressure of the keg at a first level recommended by the beverage supplier. A pressure of 15 psig (1.0 bar) is commonly used for many beers. It should be understood that this pressure may deviate ±2 psi (0.14 bar) and still be considered substantially at the recommended pressure level. Alternatively, a compressor can apply pressurized air to the keg, or a pump system can be used to transport the beverage from the keg 12 to the beverage dispensing system 10 at the recommended pressure. The keg pressure is commonly referred to as the "rack" pressure, and may be applied to several kegs within the establishment at which the beverages are being served.

The application of pressure to the keg 12 forces the beverage from an outlet through a dispensing line 18. The beverage line 18 is connected to an internal coil of a conventional chiller 20 which lowers the temperature of the beverage to a desired dispensing temperature. Although many establishments store the keg 12 in a walk-in refrigeration unit, that may not be the case for a high volume establishment. Also when a keg is exhausted, a replacement may be obtained from an unrefrigerated area. After being chilled, the beverage flows through line 22 to an inlet valve 24 of a beverage reservoir 26 at the location at which the beverage will be dispensed into serving containers. The inlet valve 24 is operated by an actuator 25 in response to an electric signal.

The reservoir 26 has a closed inner chamber 28 into which the beverage flows when the inlet valve 24 is opened. An outer wall of the reservoir 26 forms an outer cavity 30 extending around the inner chamber 28. Chilled glycol is circulated through this outer cavity 30 to maintain the contents of the inner chamber 28 at the proper temperature (e.g. approximately 35° F.). Specifically, a pump 32 draws glycol from the outer cavity 30 via an outlet line 34 and forces the glycol through another coil within the chiller 20. This cools the glycol to the desired temperature and the chilled glycol is returned through an inlet line 36 to the outer cavity 30 of the reservoir 26. Baffles may be provided within the outer cavity 30 to ensure that the chilled glycol flows completely around the inner chamber 28 to maintain the beverage 38 therein at a relatively uniform temperature.

The beverage 38 partially fills the inner chamber 28 to a height that is detected by a level sensor 40. The upper portion 42 of the closed inner chamber 28 is filled with a mixture of air and carbon dioxide which outgasses from the beverage. A breather tube 44 extends between the inner chamber 28 and the ambient atmosphere and has a pressure control valve 46 that is operated by an actuator 48. As will be described, the pressure control valve 46 is opened to vent the gas in the inner chamber 28 into the ambient environment. A filter 45 may be provided to trap any contaminate from entering through the breather tube 44.

The valves 24 and 46 are electrically operated by signals from a controller 50 in response to the signal from the level sensor 40. The controller 50 has a conventional hardware design that is based on a microcomputer and a memory in which the programs and data for execution by the microcomputer are stored. The microcomputer is connected input and output circuits that interface the controller to switches, sensors and valves of the beverage dispenser 10. The software executed by the controller responds to those input signals by operating the valves 24 and 46 as will be described.

With continuing reference to FIG. 1, the reservoir 26 includes a dispensing spout 52 extending downwardly there from. The flow of beverage through the spout 52 is controlled by a movable dispensing valve element 53 that is mounted at the lower end of a tube which extends vertically through the spout 52 and the reservoir 26. An upper end of the tube 54 passes through a seal 55 and is connected to an actuator 56, which raises and lowers the tube. That motion brings the dispensing valve element 53 into and out of engagement with the spout to allow beverage to flow into a serving container 70 placed there beneath. The actuator 56 is operated by signals from the controller 50, as will be described.

A switch 58 is mounted on the valve element 53 and is depressed by the bottom of a serving container 70 placed under the spout 52 and raised upward. The switch 58 is connected by wires which run through the tube 54, emerge from the actuator 56 and extending to an input of the controller 50.

The beverage is supplied to the reservoir 26 from the keg at a first pressure level P1 that corresponds to the rack pressure of the keg 12 (e.g. 15 psig). While the beverage 38 is being held in the reservoir 26 the pressure control valve 46 is closed so that the reservoir is sealed from the atmosphere surrounding the dispenser. This maintains the pressure within inner chamber 28 at a second pressure level P2 that is referred to as the "holding pressure." The second pressure level is substantially greater than atmospheric pressure, that is at least one psi and preferably at least five psi above atmospheric pressure for beer. Because the holding pressure is substantially above atmospheric pressure and because the beverage in the reservoir is held at a relatively low temperature (e.g. approximately 35° F.), outgassing of the beverage is minimized during the relatively brief period of time that the beverage remains in the reservoir.

When a server desires to dispense the beverage, an open serving container 70 is placed beneath the spout 52 and moved upward until the bottom of the container presses the switch 58 on the valve element 53. This transmits a signal to the controller 50 indicating that a beverage dispensing operation should commence.

If the beverage is dispensed through the spout 52 at the holding pressure P2, turbulence may occur producing excessive foam in the beverage container which is an undesirable effect. It has been discovered that minimal foaming occurs in the serving container 70 when the pressure in the inner chamber 28 substantially equals that of the container. A slight pressure difference, ±1 psi for example, can exist without producing an excessive amount of foam which would deprive the customer of a full serving of the beverage. As a consequence with reference to FIG. 2, when the controller 50 initiates a pour cycle at time T1, the pressure control valve 46 in FIG. 1 is opened to vent the pressure within the inner chamber 28 through the breather tube 44 to the outside atmosphere. This decreases the pressure within inner chamber 28 from the holding pressure P2 to a lower dispensing pressure P3 which is substantially equal to atmospheric pressure.

After the pressure control valve 46 has been open for a sufficient period of time, interval T1 to T2, so that the inner chamber pressure has reached atmospheric pressure P3, the controller 50 energizes the actuator 56 at time T2, which causes the dispensing valve element 53 to move away from the end of the spout 52. This opens a passage for fluid to flow from the spout 52 into the serving container 70 held there beneath. The contour of pour provided by this movement of the valve member 53 is defined by characteristics of the beverage, the temperature of the beverage, and the pressure at which the pour is occurring. The shape of the contour can be varied by controlling the displacement of the valve element 53 with respect to the end of the spout 52 and thereby create a desired amount of foam during the dispensing operation.

In the preferred version of the dispensing system 10 the pressure control valve 46 remains open as the dispensing valve element 53 opens so that the inner chamber continues to be vented to the atmosphere. However, as the spout valve element cracks open, the beverage may tend to flow through the initial small opening at a relatively high velocity which produces turbulence and thus foam in the serving container 70. This adverse effect can be prevented by optionally creating a negative pressure in the spout 52 which restricts the beverage flow until the valve has opened to a point at which foaming is unlikely to occur. To accomplish this variation, the controller 50 closes the pressure control valve 46 at time T2 when the dispensing valve element 53 opens. This action seals the upper portion 42 of the inner chamber 28 from the external atmosphere. Therefore, as the spout 52 opens, a slight vacuum is created due to the weight of the beverage in the reservoir. This limits the initial flow of beverage from the spout 52 to a relatively small quantity, which is particularly important for extremely carbonated beverages that foam easily. However, the duration of the negative pressure (indicted by dashed line 72) is relatively short as the pressure control valve opens again at T3. Thus the pressure within inner chamber 28 returns to the atmospheric level at time T4 at which pressure level the inner chamber remains during the rest of the beverage dispensing time.

At some point during the dispensing operation, designated time T5, the level of the beverage in the inner chamber 28 decreases to a point that the level sensor 40 sends a signal to the controller 50. The controller 50 responds by activating the actuator 25 for the beverage inlet valve 24 to add beverage from the keg 12 into the reservoir 26. Although the beverage entering the inner chamber 28 is at the relatively high rack pressure of the keg (e.g. 15 psig), the inner chamber still is vented to the atmosphere through the passage provided by the open breather tube 44. As a consequence, the pressure within the inner chamber remains substantially at the atmospheric pressure level. Because the additional beverage is introduced below the level of beverage in the reservoir, this pressure differential does not produce foaming.

The beverage continues to flow from the spout 52 between times T2 and T6 while pressure in the reservoir is maintained at the atmospheric dispensing level P3. The controller is programmed to hold the dispensing valve element 53 in the open position for a predefined interval corresponding to the amount of time required to fill the serving container 70. In high volume dispensing operations, such as at a sports venue, beer typically is sold is only one size of container. Therefore the dispenser's controller 50 can be programmed with the corresponding dispensing period required to fill such serving containers. If serving containers of different sizes are being used, a control panel with pushbutton switches for each different container size can be provided to enable the operator to signal the controller 50 as to the size of the particular container to be filled.

When the dispensing period elapses at time T6, the controller 50 de-energizes the spout actuator 56, thereby closing the valve element 53. However the beverage continues to flow into the inner chamber 28 from the keg 12 and the breather tube 44 remains open to vent air displaced by the entering beverage.

At time T7 the level indicator 40 signals the controller 50 that the reservoir 26 contained the desired amount of carbonated beverage. In response to that signal, the controller 50 operates the valve element 46 to close the breather tube 44 and seal the inner chamber 28 from the surrounding atmosphere. The inlet valve 24 remains open for a fixed period of time (T7 to T8) to add enough additional beverage into the inner chamber 28 so that the internal pressure increases to the holding pressure level P2, as depicted graphically in FIG. 2. It has been determined that there is a correlation between the amount of time that the beverage continues to flow after closing the breather tube 44 and the internal pressure level. The length of the interval that the inlet valve 24 remains open is determined empirically for a given rack pressure in the keg 12. When the controller determines that this time period has elapsed, the inlet valve 24 is closed at time T8. It should be understood that the relative position of the points in time in FIG. 2 are exemplary and the specific relationships will vary depending on the characteristics of a given dispensing system.

Figure 2:
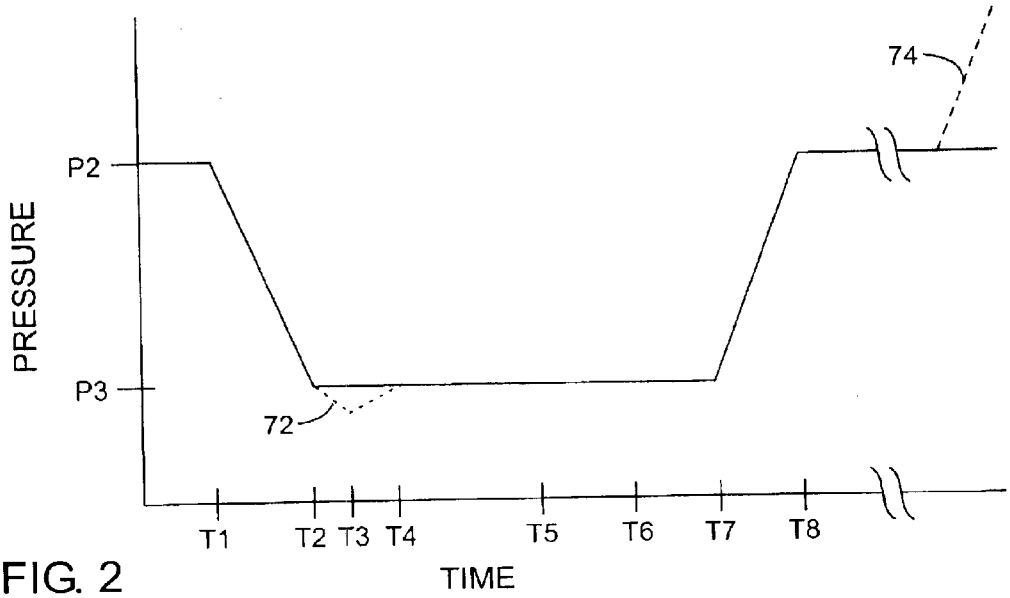
FIG. 2 is a graph of the pressure in a reservoir while beverage is being dispensed into a container.

When the beverage establishment closes, such as at the end of the business day, the reservoir 26 is brought up to the rack pressure P1 as denoted by the dashed line 74 in FIG. 2. This will maintain the beverage 38 stored in the reservoir at a pressure where minimal degassing occurs. The inner chamber pressure is lowered again to the holding pressure P2 when the establishment reopens or at the commencement of the next dispensing operation. In instances where a relatively long time period (e.g. ten minutes) elapses after a previous dispensing operation, the reservoir pressure can be increased to the rack pressure P1 to further limit the degassing.

The present beverage dispensing system 10 employs a closed reservoir 26 that prevents contaminants from entering which would adversely effect the beverage being stored in the dispenser. At the same time, the pressure of the beverage is regulated so that it is stored at a sufficiently high pressure to prevent gas from escaping from the beverage, and at a relatively low pressure so that the pressure can be rapidly decreased to the atmospheric level for pouring into a serving container with minimal foaming. The present system does not require pressure sensors to properly control the pressure level in the storage reservoir 26.

The foregoing description was primarily directed to a preferred embodiment of the invention. Although some attention was given to various alternatives within the scope of the invention, it is anticipated that one skilled in the art will likely realize additional alternatives that arc now apparent from disclosure of embodiments of the invention. Accordingly, the scope of the invention should be determined from the following claims and not limited by the above disclosure.

I claim:

1. A method for operating a system to dispense a carbonated beverage into a serving container at an establishment, that method comprising:

connecting a reservoir of the system to a source which supplies the carbonated beverage at a first pressure level that is greater than atmospheric pressure;

maintaining carbonated beverage in the reservoir at a second pressure level that is less than the first pressure level and substantially greater than atmospheric pressure;

when dispensing the carbonated beverage into the serving container is desired, opening a vent passage between the reservoir and an ambient environment to lower pressure in the reservoir to substantially the atmospheric pressure;

commencing to dispense the carbonated beverage from the reservoir into the serving container, after pressure in the reservoir is at substantially the atmospheric pressure; and terminating dispensing the carbonated beverage from the reservoir into the serving container.

2. The method as recited in claim 1 further comprising:

subsequent to commencing to dispense the carbonated beverage, sensing how much carbonated beverage is contained in the reservoir; and in response to the sensing, transferring the carbonated beverage from the source to the reservoir.

3. The method recited in claim 2 further comprising closing the vent passage for a period of time upon commencement of dispensing the carbonated beverage.

4. The method as recited in claim 2 further comprising:

subsequent to terminating dispensing the carbonated beverage, closing the vent passage for a period of time; and transferring the carbonated beverage from the source to the reservoir for a predefined period of time after closing the vent passage.

5. The method as recited in claim 1 further comprising:

sensing how much carbonated beverage is contained in the reservoir;

when less than a first predefined amount of carbonated beverage is contained in the reservoir, transferring the carbonated beverage from the source to the reservoir;

when a second predefined amount of carbonated beverage is contained in the reservoir, closing the vent passage; and terminating transferring the carbonated beverage a predetermined period of time after closing the vent passage.

6. The method as recited in claim 1 further comprising:

subsequent to commencing to dispense the carbonated beverage, sensing how much carbonated beverage is contained in the reservoir;

in response to the sensing, transferring the carbonated beverage from the source to the reservoir; and in response to the sensing, terminating transferring the carbonated beverage from the source to the reservoir.

7. The method recited in claim 6 wherein sensing how much carbonated beverage is contained in the reservoir comprises sensing a height of a surface of the carbonated beverage in the reservoir.

8. The method as recited in claim 1 wherein the second pressure level is greater than one psi above atmospheric pressure.

9. The method as recited in claim 1 wherein the second pressure level is substantially five psi above atmospheric pressure.

10. The method as recited in claim 1 wherein the first pressure level is substantially fifteen psi above atmospheric pressure.

11. The method as recited in claim 1 wherein the carbonated beverage is maintained at the first pressure level while being transferred from the source to the reservoir.

12. The method recited in claim 1 further comprising maintaining the carbonated beverage in the reservoir at substantially the first pressure level when the establishment is closed for business.

13. The method recited in claim 1 further comprising raising pressure of the carbonated beverage in the reservoir to substantially the first pressure level when at given period of time has elapsed after terminating dispensing the carbonated beverage.

14. A method for operating a system to dispense a carbonated beverage into a serving container at an establishment, that method comprising:

connecting a reservoir of the system to a source which supplies the carbonated beverage at a first pressure level that is greater than atmospheric pressure;

holding carbonated beverage in the reservoir at a second pressure level that is less than the first pressure level and substantially greater than atmospheric pressure;

when dispensing the carbonated beverage into the serving container is desired, opening a vent passage between the reservoir and an ambient environment to lower pressure in the reservoir to substantially the atmospheric pressure;

dispensing a quantity of carbonated beverage from the reservoir into the serving container, after pressure in the reservoir is at substantially the atmospheric pressure;

sensing how much carbonated beverage is contained in the reservoir;

transferring the carbonated beverage from the source to the reservoir when less than a first predefined amount of carbonated beverage is contained in the reservoir;

closing the vent passage when at least a second predefined amount of carbonated beverage is contained in the reservoir; and terminating transfer of the carbonated beverage in response to at least a second predefined amount of carbonated beverage being contained in the reservoir.

15. The method recited in claim 14 wherein sensing how much carbonated beverage is contained in the reservoir comprises sensing a height of a surface of the carbonated beverage in the reservoir.

16. The method recited in claim 14 wherein transfer of the carbonated beverage terminates a predetermined period of time after closing the vent passage.

17. A method for operating a system to dispense a carbonated beverage into a serving container at an establishment, that method comprising:

connecting a reservoir of the system to a source which supplies the carbonated beverage at a first pressure level that is greater than atmospheric pressure;

maintaining carbonated beverage in the reservoir at a second pressure level that is less than the first pressure level and substantially greater than atmospheric pressure;

when dispensing the carbonated beverage into the serving container is desired, opening a vent passage between the reservoir and an ambient environment to lower pressure in the reservoir to substantially the atmospheric pressure;

dispensing a quantity of carbonated beverage from the reservoir into the serving container, after pressure in the reservoir is at substantially the atmospheric pressure;

sensing how much carbonated beverage is contained in the reservoir;

transferring the carbonated beverage from the source to the reservoir when less than a first predefined amount of carbonated beverage is contained in the reservoir;

closing the vent passage when at least a second predefined amount of carbonated beverage is contained in the reservoir; and terminating transfer of the carbonated beverage a predetermined period of time after closing the vent passage.

* * * * *